US006986673B2

(12) United States Patent
de la Borbolla

(10) Patent No.: US 6,986,673 B2
(45) Date of Patent: Jan. 17, 2006

(54) GROUNDING CLAMP FOR RAISED FLOOR

(75) Inventor: Ian Rubin de la Borbolla, Memphis, TN (US)

(73) Assignee: Thomas & Betts International, Inc., Wilmington, DE (US)

( * ) Notice: Subject to any disclaimer, the term of this patent is extended or adjusted under 35 U.S.C. 154(b) by 0 days.

(21) Appl. No.: 11/097,554

(22) Filed: Apr. 1, 2005

(65) Prior Publication Data

US 2005/0227516 A1 Oct. 13, 2005

Related U.S. Application Data

(60) Provisional application No. 60/561,107, filed on Apr. 9, 2004.

(51) Int. Cl.
*H01R 13/648* (2006.01)

(52) U.S. Cl. ..... 439/100; 439/95

(58) Field of Classification Search ..... 439/100, 439/92, 95, 97, 208, 101, 102
See application file for complete search history.

(56) References Cited

U.S. PATENT DOCUMENTS

| | | | | |
|---|---|---|---|---|
| 1,276,228 A | | 8/1918 | Keenan et al. | |
| 2,786,192 A | * | 3/1957 | Wooley, Jr. | 439/880 |
| 3,924,920 A | * | 12/1975 | Moscioni et al. | 439/781 |
| 4,105,272 A | * | 8/1978 | West et al. | 439/100 |
| 4,114,977 A | * | 9/1978 | Polidori | 439/791 |
| 4,428,104 A | | 1/1984 | Smith | |
| 4,863,390 A | * | 9/1989 | Cera et al. | 439/100 |
| 4,915,653 A | * | 4/1990 | Mair | 439/781 |
| 5,041,012 A | * | 8/1991 | Caprio | 439/413 |
| 5,286,211 A | * | 2/1994 | McIntosh | 439/100 |
| 5,320,565 A | | 6/1994 | Polidori | |
| 5,593,327 A | * | 1/1997 | Hlinsky et al. | 439/811 |
| 5,616,036 A | * | 4/1997 | Polidori | 439/100 |
| 5,632,633 A | * | 5/1997 | Roosdorp et al. | 439/100 |
| 5,752,860 A | * | 5/1998 | Greaves | 439/781 |
| 5,934,818 A | | 8/1999 | Schmitt et al. | |
| 6,011,218 A | | 1/2000 | Burek et al. | |
| 6,040,525 A | | 3/2000 | Chauquet et al. | |
| 6,045,414 A | * | 4/2000 | DeFrance | 439/794 |
| 6,398,596 B1 | | 6/2002 | Malin | |

* cited by examiner

*Primary Examiner*—Tulsidas C. Patel
(74) *Attorney, Agent, or Firm*—Hoffmann & Baron, LLP

(57) ABSTRACT

An electrical grounding clamp which connects one or more grounding lines to a grounding post. The grounding clamp includes a top section having an aperture; a pair of opposing side walls extending downwardly from the top section; one or more members extending downwardly from each of the side walls and forming a bottom seating surface; a wire nut tensioner and a clamping bolt extending through the aperture in the top section and engaging the wire nut tensioner. The top section and wire nut tensioner act cooperatively to form a pair of clamps which are adapted to accommodate grounding lines and the bottom seating surface are adapted to accommodate grounding lines.

29 Claims, 8 Drawing Sheets

GROUNDING CLAMP FOR RAISED FLOOR

This application claims priority from provisional application Ser. No. 60/561,107, filed on Apr. 9, 2004.

FIELD OF THE INVENTION

The present invention relates to a grounding clamp for electrically and mechanically connecting an electrical conductor to a grounding post. More particularly, the present invention relates to a grounding clamp for attaching wires to a grounding post in raised floor applications.

BACKGROUND OF INVENTION

Grounding of electrical systems is a practice which accomplishes multiple functions. Foremost among these functions is protection from shock hazard due to lightning, power surges, ground faults and inadvertent contact with high voltage lines. To prevent personal injury due to such electrical hazards, it has long been known in the electrical field to use low resistance ground connections to earth.

However, with the advent and widespread use of highly sensitive computer components, grounding has also been found to be necessary for the reliable operation of such components. Typically, computers and other advanced data processing equipment are located and operated in a dedicated room or area in a commercial building. These rooms are usually well air-conditioned to prevent over-heating of the equipment and, consequently, these rooms have a low-humidity level. Computer operators and other personnel working in these areas can create a build-up of static electricity in their body as a result of movement in this dry environment. Subsequent contact with static sensitive computer equipment can dissipate this static charge through the equipment, impeding its operating reliability and performance. Therefore, static shielding of computer equipment is highly desirable. Further, the signal frequencies of high speed computers reach and exceed 10 megahertz. The radiation of these high frequencies can also be troublesome to computer operation. Accordingly, shielding of computer circuits from such signal "noise" is also advantageous.

One method currently practiced for providing signal and static grounding uses a signal reference grid beneath the floor supporting the computer equipment. The signal reference grid, which is typically run beneath a raised floor, is electrically connected along its length to the various computer components and at one end to earth, either directly or indirectly. This provides adequate signal grounding to reduce signal "noise" radiated at high frequencies. The signal reference grid is also useful in providing static protection for the computer hardware. The raised flooring in a computer area is typically formed of a semi-conductive material, and is supported on modular floor supports made of steel or aluminum. It is desirous to electrically connect the floor supports to the signal reference grid so that the floor and the computer terminals are at the same electrical potential. A computer operator standing on the semi-conductive floor will then be at the same electrical potential as the computer terminal, eliminating any chances of static dissipation between the operator and the terminal.

The art has seen various types of grounding connectors and other devices which connect one cable to another. Examples of these are shown in U.S. Pat. No. 1,276,228 to Keenan et al. and U.S. Pat. No. 2,786,192 to Woolley, Jr. The grounding clamps that are currently in use attach single grounds and multiple grounds to the grounding clamp in a variety of different ways. Typically, these grounding clamps consist of a holding device for receiving the wire and a tightening bolt to secure it in place. Some styles of grounding clamps require special tools for assembly and installation, which can only be purchased from the manufacturer. Grounding clamps with multiple branches for connecting a plurality of grounding wires are always preferable over a single unit. However, many of the grounding clamps currently available can only be used with a limited range of wire sizes, for example 4 to 8 AWG. Also, many of the grounding clamps currently available can only be used with grounding posts within a limited range of sizes. For example, these grounding clamps can be used with a ⅞-inch or 1-inch grounding post, but cannot be used with a ½-inch or 1½-inch grounding post. Accordingly, there is a need for a grounding clamp that can be used to connect multiple wires of different sizes and that can be used with grounding posts that have a wide range of sizes.

SUMMARY OF THE INVENTION

In accordance with the present invention, an electrical grounding clamp which connects one or more grounding lines (either wires or cables) to a grounding post is provided. The grounding clamp includes: a top section having an aperture; a pair of opposing side walls extending downwardly from the top section; at least one member, preferably a pair of members, extending downwardly from each of the side walls; and a clamping bolt extending through the aperture in the top section. Each member has a bottom seating surface adapted to accommodate a grounding line.

The top section and the side walls are adapted to receive a grounding post. When the grounding lines are installed and the clamping bolt tightened, the grounding lines electrically and mechanically contact the bottom seating surfaces. In preferred embodiments, either the aperture in the top section is threaded and engages the clamping bolt or a wire nut tensioner having a threaded opening accommodates the clamping bolt. The top section and wire nut tensioner act cooperatively to form a pair of clamps which are adapted to accommodate grounding lines.

The grounding clamp can also include at least one grounding post adapter clip, preferably a pair of grounding post adapter clips (also referred to herein as post adapters), which are positioned between at least one of the side walls and the grounding post. One or both of the side walls can have one or more apertures, which are adapted to receive the adapter clips. In addition, at least one bottom seating surface, member and side wall forms at least one slot in each side wall and preferably more than one slot is formed. In addition, one or more of the bottom seating surfaces can have a lip. In another embodiment, each of the side walls has at least one notch which extends upwardly from at least one of the slots. A fitting plate or a half-fitting plate is accommodated by the slots and notches in the opposing side walls.

In another embodiment, the grounding clamp includes: a top section having opposing sides and an aperture, preferably located in the center; a pair of side walls extending downwardly from the opposing sides of the top section, a pair of bottom seating surfaces connected to each of the side walls; a wire nut tensioner having an opening, preferably in the center; and a clamping bolt. The clamping bolt extends through the aperture in the top section and engages the threaded opening in the wire nut tensioner.

The top section and the wire nut tensioner form at least one clamp, preferably a pair of clamps, which are adapted to accommodate grounding lines. The bottom seating surfaces are also adapted to accommodate grounding lines. Tightening the clamping bolt electrically and mechanically contacts the bottom seating surfaces and the clamps with the grounding lines. Preferably, the pair of side walls, the wire nut tensioner and the clamping bolt are formed from electrically conductive material.

The top section of the grounding clamp has first and second ends and the wire nut tensioner has opposing ends which, acting in cooperation, form one or more clamps for securing grounding lines. In preferred embodiments, the opening in the wire nut tensioner is threaded so that the clamps close when the clamping bolt is tightened and engages the wire nut tensioner. Preferably, the opening in the wire nut tensioner corresponds to the aperture in the top section when the wire nut tensioner is positioned between the side walls.

The grounding clamp can also include a fitting plate which extends between at least one of the bottom seating surfaces on each of the side walls. In addition, one or more of the bottom seating surfaces can have a plurality of teeth extending upwardly from the seating surfaces for penetrating the protective cover of the grounding line and electrically contacting the conductor. The grounding clamp can also include a first adapter clip and a second adapter clip, wherein the first and second adapter clips are positioned on the interior surfaces of the first and second side walls and wherein each of the side walls has an opening for engaging the adapter clips.

A further embodiment of the grounding clamp includes: a top section having a first end, a second end, a first side, a second side and an aperture, preferably in the center; a pair of side walls extending downwardly from the first and second sides of the top section; a wire nut tensioner having two opposing ends and a threaded opening, preferably in the center; a clamping bolt; and one or more slots in each side wall formed by the side wall, one of the members and one of the bottom seating surfaces.

A pair of clamps are formed by the first and second ends of the top section and the opposing ends of the wire nut tensioner acting in cooperation. The clamping bolt extends through the aperture in the top section and engages and passes through the threaded opening in the wire nut tensioner. Preferably, the top section, the pair of side walls, the wire nut tensioner, the bottom seating surfaces, the members and the clamping bolt are formed from electrically conductive material. In other preferred embodiments, the bottom seating surfaces extend outwardly from the side wall and form feet.

BRIEF DESCRIPTION OF THE FIGURES

Other objects and many attendant features of this invention will be readily appreciated as the invention becomes better understood by reference to the following detailed description when considered in connection with the accompanying drawings wherein.

DETAILED DESCRIPTION OF THE INVENTION

Figure 1:
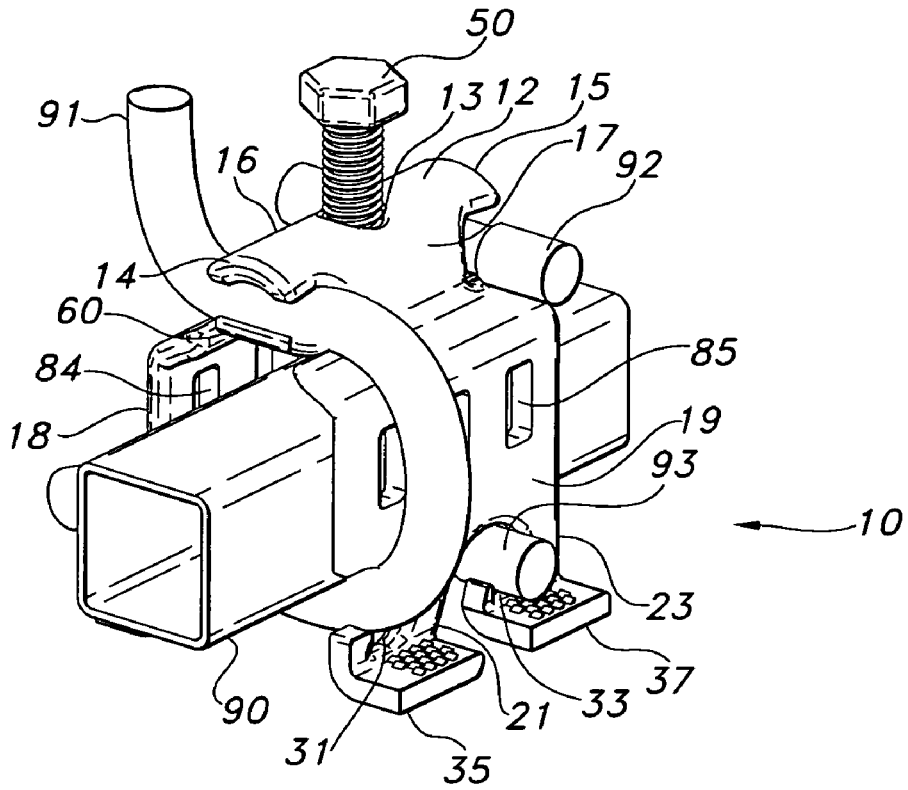
FIG. 1 is a perspective view of a grounding clamp showing the connection of three grounding lines to a grounding post.

The present invention is a grounding clamp that provides ease and flexibility for electrically and mechanically connecting one or more electrical grounding lines to a grounding post. The grounding clamp is designed for use in new or existing raised floor applications and removable adapter clips positioned on the interior side walls enable the clamp to fit a wide range of grounding post shapes and sizes. The grounding clamp allows for multiple grounding lines to be configured parallel to or perpendicular to the grounding cable run, and holds up to two pairs of grounding lines, i.e. wires or cables ranging from 0 AWG to 3000 kcmil in size, preferably from 0 to 8 AWG in size.

When fastening the grounding clamp to the grounding post, wire nut tensioners with different size seating surfaces are used to ensure that cables of all sizes can be properly secured to the grounding clamp. In one embodiment, teeth are placed on one or more of the four main seating surfaces of the grounding clamp. These teeth penetrate the sheath or other protective covering on insulated wires when the grounding clamp is assembled and electrically connect the conductor in the wire or cable to the grounding clamp. This allows grounding lines to be connected to the grounding clamp without first stripping the outer sheathing to expose the conductor. The teeth pass through the insulation on the grounding line and the clamping bolt is tightened until proper electrical connectivity is achieved.

The grounding clamp allows multiple grounding lines to be attached to a single grounding post, whether the grounding post is parallel to or perpendicular to the grounding lines. The grounding clamp also provides a secure electrical and mechanical connection between the grounding lines and the grounding clamp in both the top section and the bottom seating surfaces in the bottom section.

Additional flexibility is provided by grounding post adapter clips which allow a single grounding clamp to be used with grounding posts of various sizes. The adapter clips are inserted between the side walls of the grounding clamp and a grounding post when the grounding post does not a sufficient cross-sectional width to contact both of the side walls. In preferred embodiments, the side walls have one or more apertures for receiving the adapter clips. Most preferably, the adapter clips have a "snap fit" so that the apertures frictionally engage the adapter clips and hold them in position. Grounding clamps currently in use are not adaptable to different size grounding posts and, as a result, the grounding clamps are limited to a relatively few applications or are not securely held in place.

The wire nut tensioner has two primary functions. It forms a pair of opposing force clamps for the ground wires connected to the top section of the grounding clamp, while at the same time it forces the grounding post against the grounding wires connected to the bottom section of the grounding clamp. Grounding clamps currently in use lack this feature, making it cumbersome to attach the grounding lines to the top section without first securing the grounding clamp to the grounding post.

The grounding clamp is installed by positioning it over a grounding post so that the side walls of the grounding clamp extend below the grounding post. The grounding lines are then placed in the top and bottom seating surfaces of the grounding clamp. (For the purposes of this disclosure, the term "grounding line" refers to any cable or wire, either insulated or stripped of insulation, which can be used to conduct electricity, and is not intended to limit the type of electrical conductors that may be used in any way.) The clamping bolt is tightened to torque specification to secure the grounding lines in the grounding clamp and to electrically and mechanically contact the grounding lines to the grounding post.

The grounding clamp, including the top section, side walls, wire nut tensioner, adapter clips, clamping bolt and all of the other component parts which are described in more detail below, are constructed of an electrically conductive metal such as copper or aluminum and can be plated with a material known by those skilled in the art for plating electrical devices, such as tin.

Figure 3:
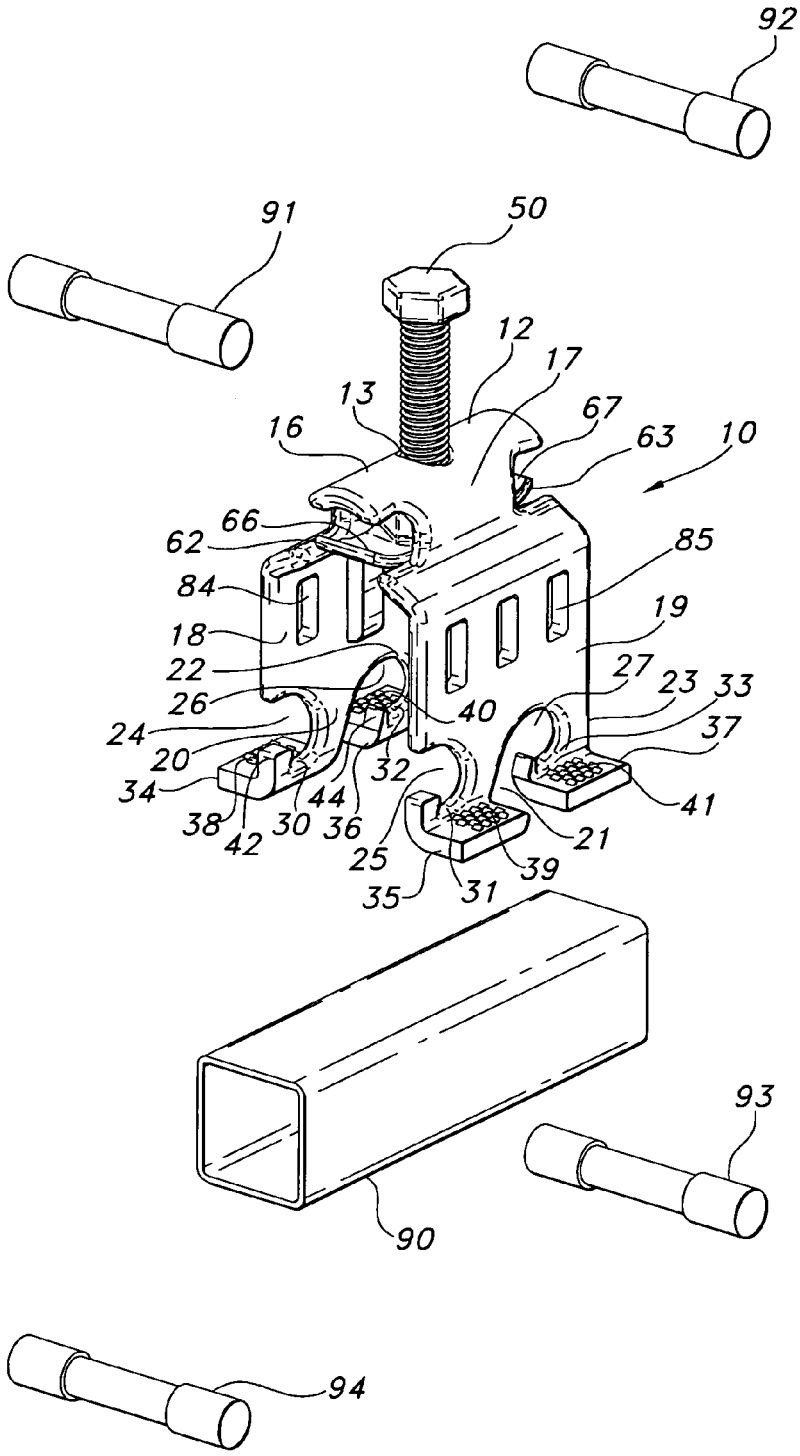
FIG. 3 is an exploded perspective view of a grounding clamp showing unconnected grounding lines and a grounding post.

Referring now to FIG. 1, there is shown a perspective view of a grounding clamp 10 connecting three grounding lines 91, 92, 93 to a grounding post 90. The grounding clamp 10 includes a top section 12 having a first end 14 and a second end 15, two sides 16, 17 that preferably curve downwardly and an opening 13 in the center for receiving, but not engaging, a threaded bolt 50. The two ends 14, 15, of the top section 12 preferably extend beyond the sides 16, 17 and have seating surfaces on the bottom for engaging grounding lines 91, 92. Each of the two sides 16, 17 of the top section 12 is joined to a side wall 18, 19 which extends downwardly. Two members 20, 22 (FIG. 3) extend from the bottom of the first side wall 18 to form two bottom seating surfaces 30, 32 for receiving grounding lines 91, 93. Two members 21, 23 (FIG. 3) also extend from the bottom of the second side wall 19 to form two bottom seating surfaces 31, 33 for receiving grounding lines 91, 93. In a preferred embodiment, these seating surfaces 30, 31, 32, 33 are openings in the side walls 18, 19, most preferably slots 24, 25, 26, 27 (FIG. 3). The seating surfaces 30, 31, 32, 33 can also extend outwardly from the side wall members 20, 21, 22, 23 to form feet 34, 35, 36, 37 (FIG. 3). The feet 34, 35, 36, 37 may include a plurality of metal teeth 38, 39, 40, 41 that penetrate the insulation on the grounding line 91, 93 and form an electrical connection between the grounding line 91, 93 and the grounding clamp 10.

Figure 4:
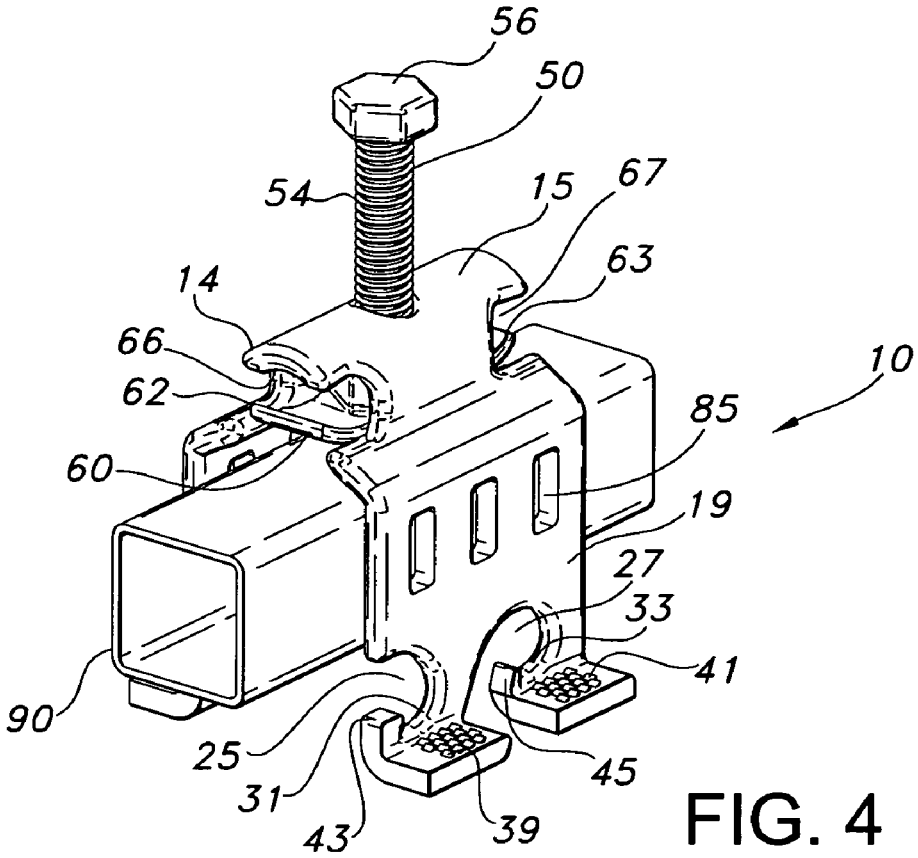
FIG. 4 is a perspective view of a grounding clamp showing the connection of the clamp to a grounding post.

A wire nut tensioner 60 is positioned between the two side walls 18, 19 and it has a substantially flat center section which extends outwardly and upwardly to form two opposing ends 62, 63 (FIG. 4), which correspond to the first and second ends 14, 15 of the top section 12. The opposing ends 62, 63 of the wire nut tensioner 60 act in cooperation with the first and second ends 14, 15 of the top section 12 to form a first and a second clamp 66, 67 (FIG. 4). These clamps 66,67 are adapted to accommodate grounding lines. The center of the wire nut tensioner 60 has an opening (not shown), preferably a threaded opening, which engages the clamping bolt 50. When the bolt 50 is tightened, the wire nut tensioner 60 moves towards the top section 12 and the clamps 66, 67 close to secure the grounding lines to the grounding clamp.

The clamping bolt 50 has a first end 52 (FIG. 10) which passes through the aperture 13 in the top section 12 and then through an opening (not shown) in the wire nut tensioner 60. As stated above, the opening in the wire nut tensioner 60 is, preferably, threaded and engages the threads on the bolt 50. After the clamping bolt 50 passes through the wire nut tensioner 60, a nut or a terminating pad 58 (FIG. 5 and FIG. 14) can be attached to the first end 52, or first end 52 can be employed without a terminating pad 58 (FIG. 15). The nut or terminating pad 58 frictionally engages the grounding post 90 to secure the grounding clamp 10 in position. In some embodiments, the nut or terminating pad 58 can be used without a wire nut tensioner 60 as shown in FIG. 15. The second end of the clamping bolt 50 has a standard hexagonal bolt head 56 which can be used with a variety of standard wrenches to turn, i.e. rotate, the clamping bolt 50. In preferred embodiments of the invention, a device for manually tightening the clamping bolt 50, such as a handle or a wheel, can be attached to the second end of the clamping bolt 50 in place of the hexagonal bolt head 56. When the grounding clamp 10 is installed, the clamping bolt 50 is rotated so that the nut or terminating pad 58, or the first end 52 itself, engages the surface of the grounding post 90. The rotation of the clamping bolt 50 also causes the wire nut tensioner 60 to move upwardly, towards the top section 12.

Figure 2:
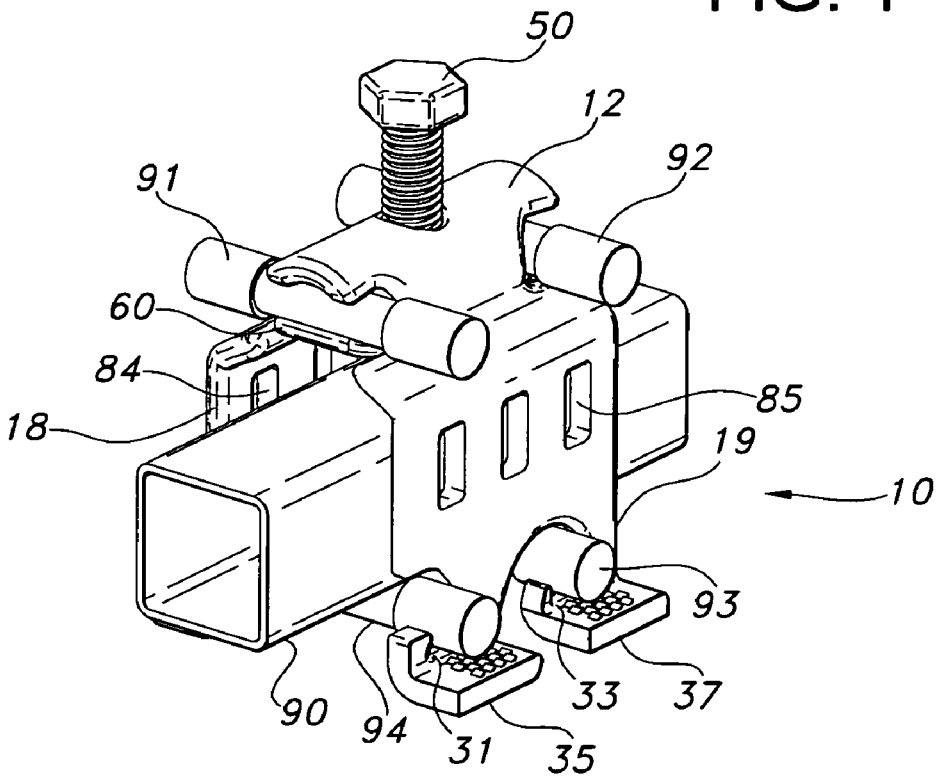
FIG. 2 is a perspective view of a grounding clamp showing the connection of four grounding lines to a grounding post.

An installed grounding clamp 10 is shown in FIG. 2 with four grounding lines 91, 92, 93, 94 connected to a grounding post 90. This illustrates how the grounding lines 93, 94 are connected to the bottom seating surfaces 30, 31 and 32, 33 (FIG. 3) and the grounding clamp 10 is secured to the grounding post 90 when the clamping bolt 50 is tightened.

The clamping bolt 50 serves two functions. First, tightening the clamping bolt 50 causes the wire nut tensioner 60, in cooperation with the top section 12, to secure the two grounding lines 91, 92. Second, the clamping bolt 50 contacts the grounding post 90 and forces it against the grounding lines 93, 94, which in turn secures and electrically contacts the grounding lines 93, 94 to the bottom seating surfaces 30, 31, 32, 33 of the grounding clamp 10.

FIG. 3 shows an exploded view of the grounding clamp 10 as well as the grounding post 90 and grounding lines 91, 92, 93, 94. FIG. 3 illustrates how the grounding post 90 is positioned between the side walls 18, 19 of the grounding clamp 10 and the ground lines 93, 94 are positioned in slots 26, 27 and 24, 25, respectively. Preferably, at least one grounding line 93 or 94 passes through a pair of the bottom seating surfaces 30, 31 or 32, 33 to maintain the grounding clamp 10 in position.

Side wall 19 has members 21, 23 which extend downwardly and then laterally to form slots 25, 27 with bottom seating surfaces 31, 33 located on the bottom side of the slots 25, 27. Similarly, side wall 18 has members 20, 22 which form slots 24, 26 with bottom seating surfaces 30, 32. In a preferred embodiment, the slots 24, 25, 26, 27 have lips 42, 43, 44, 45, which engage the grounding lines when they are positioned on the seating surfaces 30, 31, 32, 33.

When the clamping bolt 50 is tightened, the grounding post 90 is forced against the grounding lines 93, 94 and secures them in the grounding clamp 10. Grounding lines 91, 92 are inserted in the clamps 66, 67 formed by the top section 12 and the wire nut tensioner 60. When the clamping bolt 50 is rotated, the first end 52 or terminating pad 58 of the bolt 50 contacts the grounding post 90 and the wire nut tensioner 60 moves upwardly to secure the grounding lines 91, 92 in the first and second clamps 66, 67. At the same time, the upward movement of the wire nut tensioner 60 causes the grounding lines wires 93, 94 to contact the bottom seating surfaces 30, 31, 32, 33 and the grounding post 90. FIG. 4 shows a grounding clamp 10 positioned on a grounding post 90 prior to the connection of the grounding lines and before the clamping bolt 50 is tightened.

Figure 5:
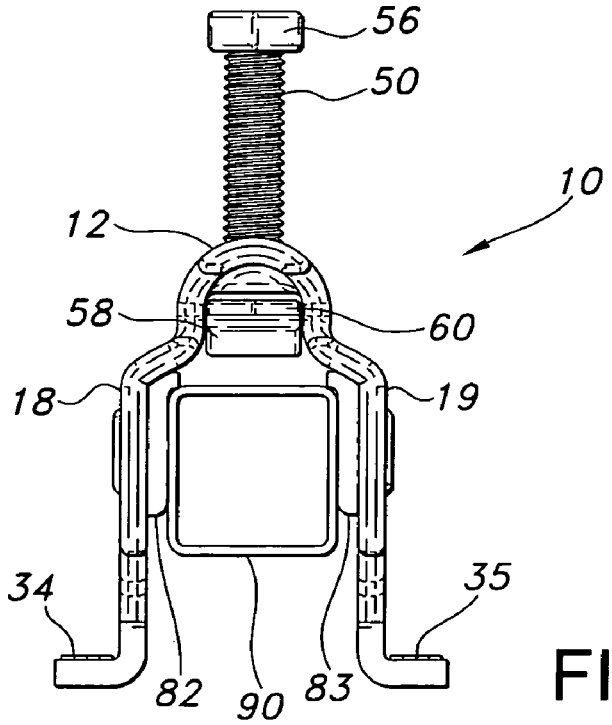
FIG. 5 is an end view of a grounding clamp showing two post adapters between a grounding clamp and a grounding post.

FIG. 5 shows an end view of the grounding clamp 10 with a convex top section 12 and substantially parallel side walls 18, 19. The feet 34, 35 extend outwardly from the side walls 18, 19, respectively, to provide additional surface area for electrically and mechanically engaging the grounding lines that are connected to the grounding clamp 10. A pair of grounding post adapter clips 82, 83 are positioned between the grounding post 90 and the side walls 18, 19 to provide a tight fit. The widths of the adapter clips 82, 83 can vary in order to accommodate different size grounding posts. This allows the grounding clamp 10 to be adapted for use with grounding posts 90 having various sizes and shapes. In preferred embodiments, the side walls 18, 19 have one or more apertures 84, 85 that are used for securing the adapter clips 82, 83 in position.

Figure 6:
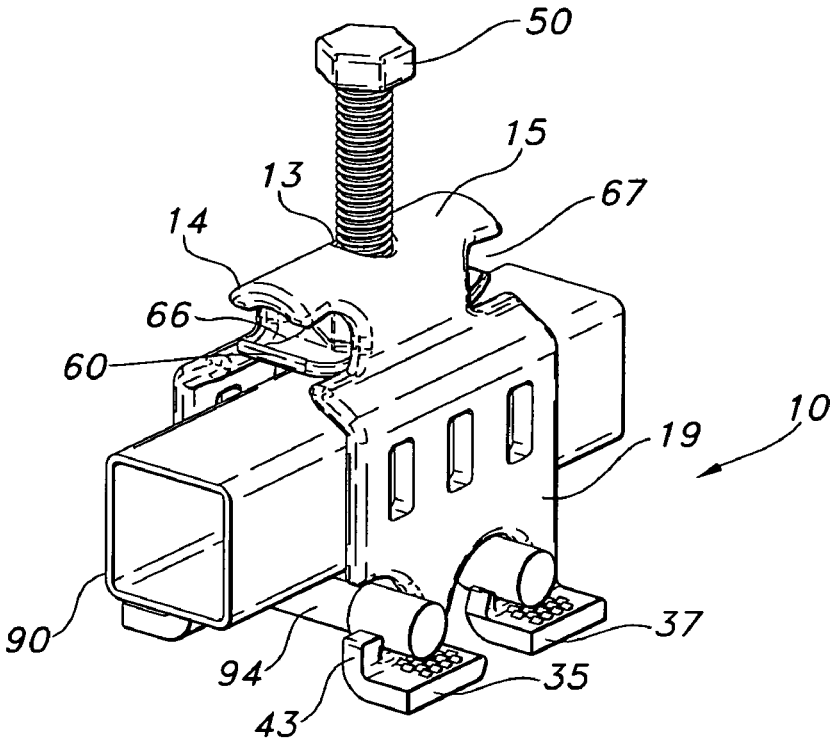
FIG. 6 is a perspective view of a grounding clamp showing the connection of two grounding lines to a grounding post.
Figure 9:
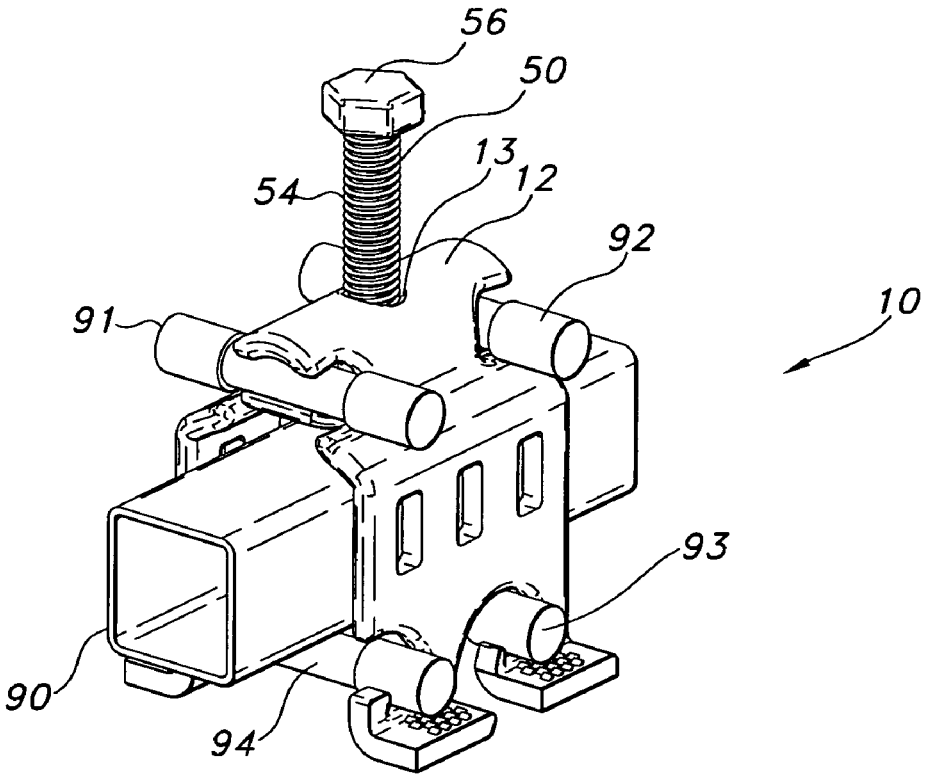
FIG. 9 is a perspective view of a grounding clamp showing the connection of four grounding lines to a grounding post.
Figure 11:
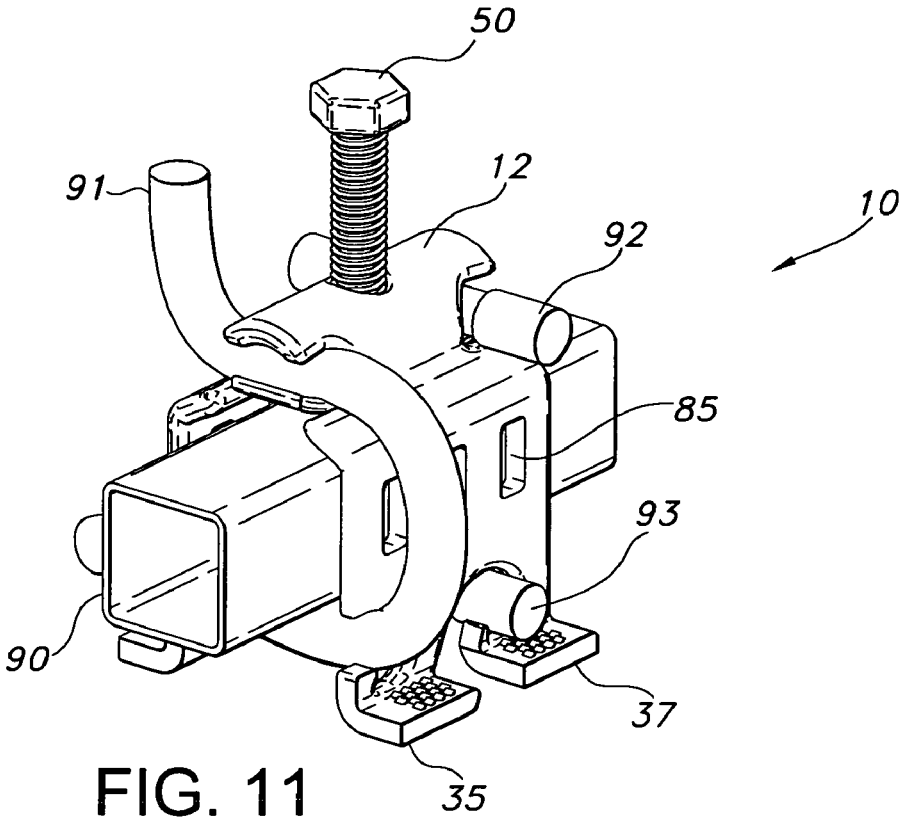
FIG. 11 is a perspective view of a grounding clamp showing the connection of three grounding lines to a grounding post.

FIGS. 6, 9 and 11 show grounding clamps 10 connecting grounding posts 90 to different numbers of grounding lines 91, 92, 93, 94. These figures show how tightening the clamping bolt 50 simultaneously secures the grounding clamp 10 to the grounding lines 91, 92, 93, 94 and the grounding post 90.

Figure 7:
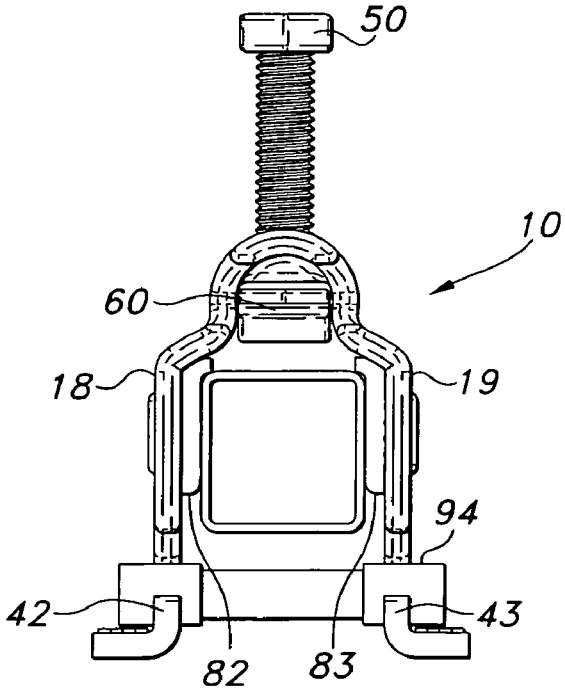
FIG. 7 is an end view of a grounding clamp showing two post adapters between the grounding clamp and a grounding post and the connection of one grounding line to the grounding post.
Figure 10:
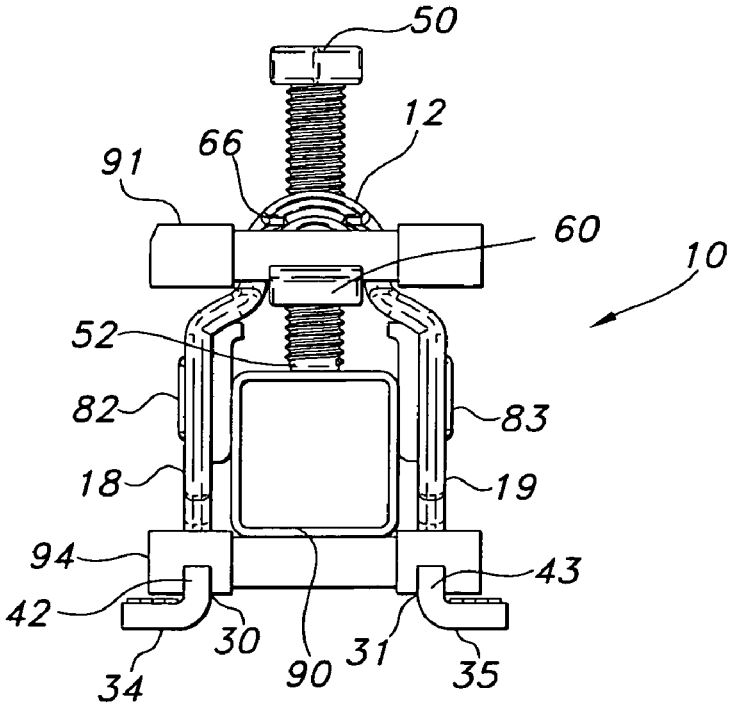
FIG. 10 is an end view of a grounding clamp showing two post adapters between the grounding clamp and a grounding post and the connection of two grounding lines to the grounding post.
Figure 12:
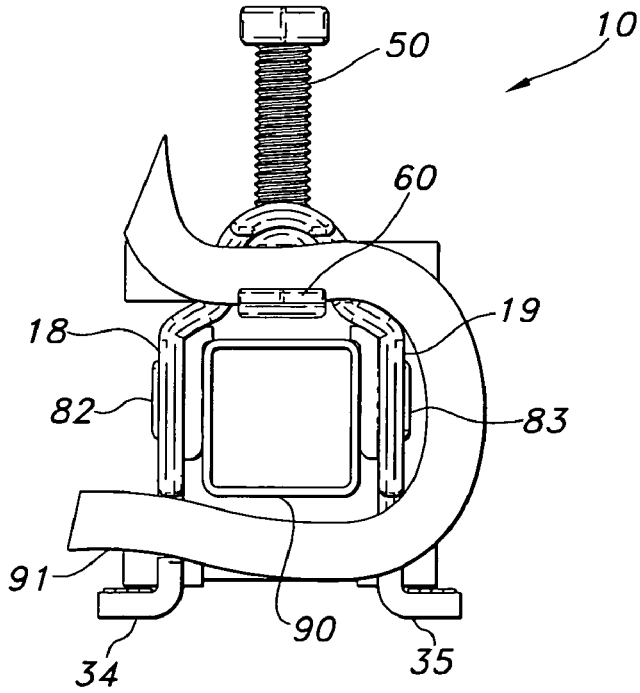
FIG. 12 is an end view of a grounding clamp showing two post adapters between the grounding clamp and a grounding post and the connection of two grounding lines to the grounding post.

FIGS. 7, 10 and 12 show end views of the grounding clamp 10 connecting grounding lines 91, 94 to grounding post 90. FIGS. 7 and 12 show the grounding clamp 10 before the clamping bolt 50 is tightened. The clamping bolt 50 is not in contact with the grounding post 90 and the grounding post 90 is not in contact with the grounding lines 91, 94. FIG. 10 shows the grounding clamp 10 after the clamping bolt 50 has been tightened and the grounding lines 91, 94 secured to the grounding clamp 10. FIG. 10 shows how the downward force of the clamping bolt 50 on the grounding post 90 secures and electrically contacts the grounding line 94 to the bottom seating surfaces 30, 31. At the same time, the first clamp 66 of the top section 12 is connected to another grounding line 91. FIG. 10 also shows the adapter clips 82, 83 protruding through the apertures 84, 85 in the side walls 18, 19 to secure them in place.

FIG. 10 illustrates how the clamping bolt 50 locks the grounding clamp 10 into position. As the clamping bolt 50 is turned, it engages the wire nut tensioner 60 and contacts the grounding post 90, pushing against the grounding post 90 and forcing it into electrical contact with the grounding line 94 positioned in the bottom seating surfaces 30, 31. At the same time, the rotation of the clamping bolt 50 causes the wire nut tensioner 60 to move upwardly and, acting in cooperation with the top section 12, secures the grounding line 91 in clamp 66.

Figure 8:
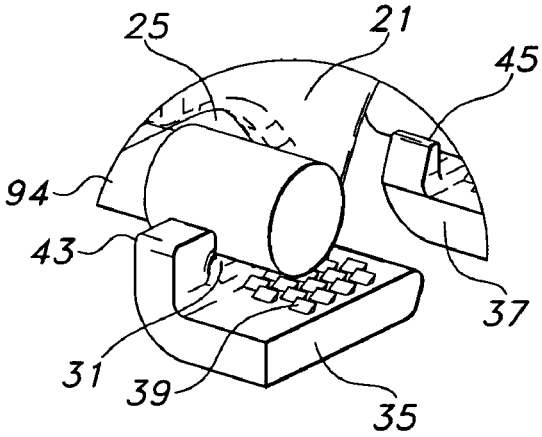
FIG. 8 is a detail view of the teeth on the bottom seating surface of a grounding clamp and shows the teeth engaging a grounding line.

FIG. 8 shows a detail of one of the bottom seating surfaces 31 of the grounding clamp 10. In this preferred embodiment, a foot 35 with a plurality of teeth 39 extends outwardly from the seating surface 31 to provide an increased seating surface. When the grounding clamp 10 is installed and the clamping bolt 50 tightened, the teeth 39 penetrate the grounding line 94 and provide an electrically conductive path between the grounding line 94 and the grounding clamp 10. FIG. 8 also shows the bottom member 21 of the side wall which, together with seating surface 31, forms a slot 25 for receiving the grounding line 94. The bottom of the slot 25 has a lip 43 which prevents the grounding line 94 from moving out of the slot 25 when the grounding clamp 10 is secured to the grounding post 90.

Figure 13:
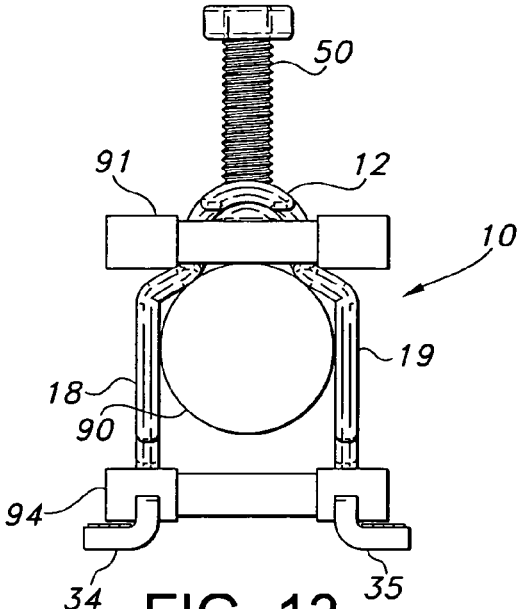
FIG. 13 is an end view of a grounding clamp showing the connection of two grounding lines.
Figure 14:
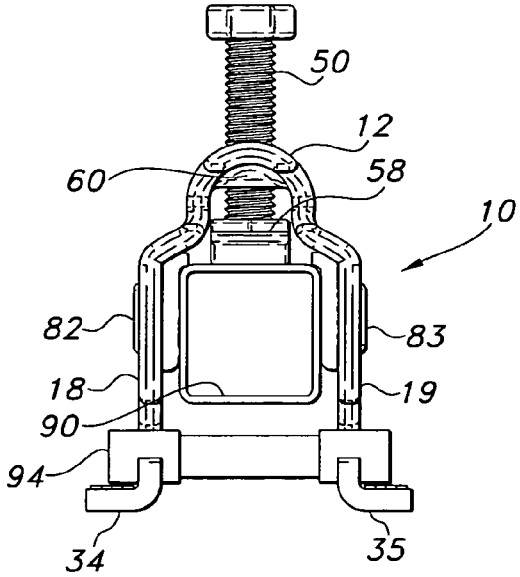
FIG. 14 is an end view of a grounding clamp showing two post adapters between the grounding clamp and a square grounding post and the connection of one grounding line.
Figure 15:
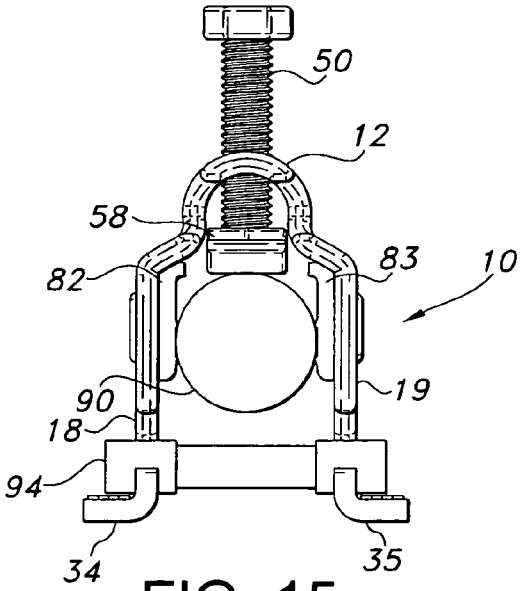
FIG. 15 is an end view of a grounding clamp showing two post adapters between the grounding clamp and a round grounding post and the connection of one grounding line.
Figure 16:
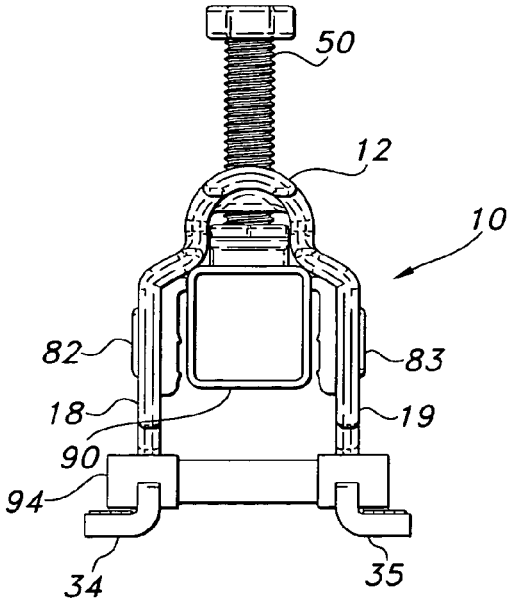
FIG. 16 is an end view of a grounding clamp showing two post adapters between the grounding clamp and a square grounding post and the connection of one grounding line.

FIGS. 13–16 show how the grounding clamp 10 can be used with grounding posts 90 having different shapes and sizes. Electrically conductive grounding post adapter clips 82, 83 are positioned between the side walls 18, 19 of the grounding clamp 10 and the grounding post 90. Different size adapter clips 82, 83, which can also have different configurations, are used with grounding posts 10 having different sizes and shapes to ensure a tight fit and an electrically conductive path between the grounding clamp 10 and the grounding post 90. FIGS. 13 and 15 show round grounding posts 10 having different diameters. The grounding post 90 in FIG. 13 contacts the side walls 18, 19, while the grounding post 90 in FIG. 15 does not contact the side walls 18, 19 and requires adapter clips 82, 83. FIGS. 14 and 16 show square grounding posts 10 with different widths which require adapter clips 82, 83 in order for the grounding post 10 to electrically contact the side walls 18, 19.

Figure 17:
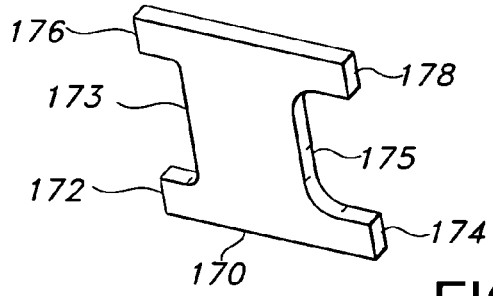
FIG. 17 is a perspective view of a fitting plate with a pair of members extending outwardly on each side.

FIG. 17 shows an I-shaped fitting plate 170 with members 172, 174 and 176, 178 extending outwardly from opposing ends to form notches 173, 175 on the opposing sides. The fitting plate 170 is formed from electrically conductive material, preferably the same material that is used to form the top section 112 and side walls 118, 119 of the grounding clamp 110. The members 172, 174 and 176, 178 of the fitting plate 170 are placed in the slots 124, 125, 126, 127 of the side walls 118, 119 (FIGS. 19 and 20), respectively, after the grounding clamp 110 is positioned on the grounding post 190. For installations of the grounding clamp that do not call for grounding lines to be installed in the bottom seating surfaces, the fitting plate is used. When the clamping bolt is tightened, the fitting plate secures the bottom of the grounding clamp to the grounding post.

Figure 18:
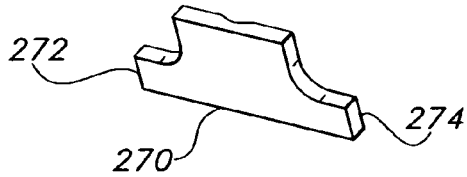
FIG. 18 is a perspective view of a half-fitting plate with one member extending outwardly on each side.

FIG. 18 shows a half-fitting plate 270 with members 272, 274 extending outwardly. The half-fitting plate 270 is used when a large grounding line is installed on one side of the bottom section of the grounding clamp and a small grounding line is installed on the other side. The half-fitting plate 270 allows the smaller grounding line to be tightly secured in place when the grounding line is positioned between the members 272, 274 and the bottom section seating surfaces. The half-fitting plate 270 can also be used when only one grounding line is connected to the bottom seating surfaces of the grounding clamp to prevent the grounding clamp from tilting to the side.

Figure 19:
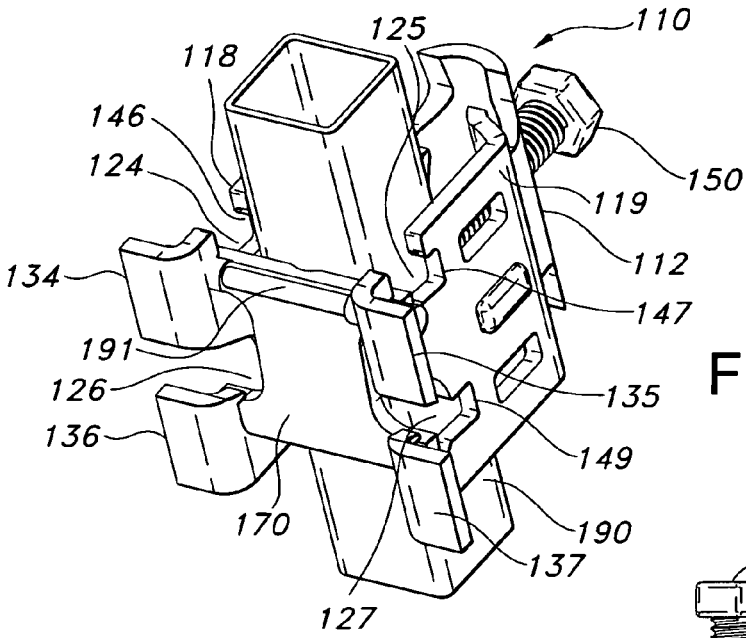
FIG. 19 is a perspective view of a grounding clamp showing four members of a fitting plate inserted between a grounding post and the bottom seating surfaces.

FIG. 19 shows a fitting plate 170 installed between a grounding post 190 and the bottom seating surfaces of a grounding clamp 110. When the clamping bolt 150 is tightened, the fitting plate 170 is forced against the grounding line 191. This electrically contacts the grounding line 191 to the grounding post 190 and the grounding clamp 110 and secures the grounding line 191 in place. To install the fitting plate 170, the members 172, 174 and 176, 178 of the fitting plate 170 are positioned in the slots 124, 126 and 125, 127 in side walls 118 and 119, respectively. In preferred embodiments, the side walls 118, 119 have notches 146, 148 and 147, 149 (notch 148 is hidden by the grounding post 190), respectively, which correspond to and receive the members 172, 174, 176, 178 of the fitting plate 170. These notches 146, 148 and 147, 149 are designed to receive the fitting plate 170 so that the fitting plate 170 does not interfere with the installation of the grounding lines 191 in the slots 124, 125, 126, 127. FIG. 19 also shows feet 134, 135, 136, 137 which extend outwardly from the side walls 118, 119 to provide additional contact surfaces for the grounding lines 191.

Figure 20:
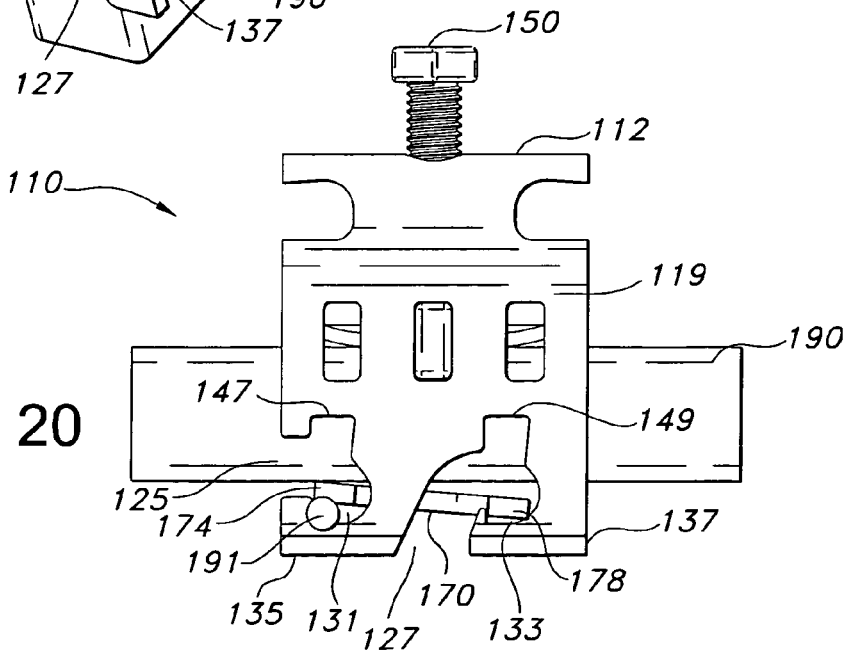
FIG. 20 is a side view of a grounding clamp showing a fitting plate inserted between a grounding post and a grounding line on one side and the bottom seating surfaces on the other side.

FIG. 20 shows a grounding clamp 110 mounted to a grounding post 190 with a member 174 of the fitting plate 170 positioned between a grounding line 191 and the grounding post 190. The member 178 on the opposing end of the fitting plate 170 is positioned on a seating surface 133 that does not have a grounding line installed. FIG. 20 shows how the members 174, 178 of the fitting plate 170 can be easily inserted into slots 125, 127 in the side wall 119. The members 172, 174, 176, 178 of the fitting plate 170 extend beyond the side walls 118, 119 (FIG. 19) and over the feet 134, 135, 136, 137. When the clamping bolt 150 is tightened, the members 172, 174, 176, 178 push down on the grounding line 191 so that it contacts the surface of the feet 134, 135, 136, 137.

Thus, while there have been described the preferred embodiments of the present invention, those skilled in the art will realize that other embodiments can be made without departing from the spirit of the invention, and it is intended to include all such further modifications and changes as come within the true scope of the claims set forth herein.

We claim:

1. A grounding clamp for electrically connecting one or more grounding lines to a grounding post, the grounding clamp comprising:

a top section having an aperture;

a pair of opposing side walls extending downwardly from the top section;

at least one member extending downwardly from each of the side walls, wherein each member has a bottom seating surface and wherein each bottom seating surface is adapted to accommodate a grounding line; and a clamping bolt extending through the aperture in the top section, wherein the side walls are adapted to receive a grounding post therebetween, and wherein the grounding lines are installed and the clamping bolt tightened to electrically and mechanically contact the grounding lines with the bottom seating surfaces.

2. The grounding clamp according to claim 1, wherein the aperture in the top section is threaded.

3. The grounding clamp according to claim 1 further comprising a wire nut tensioner having a threaded opening, wherein the threaded opening accommodates the clamping bolt.

4. The grounding clamp according to claim 3, wherein the top section and wire nut tensioner form a pair of clamps, and wherein the clamps are adapted to accommodate grounding lines.

5. The grounding clamp according to claim 1 further comprising at least one adapter clip, wherein the adapter clip is positioned between the pair of side walls.

6. The grounding clamp according to claim 5, wherein the side walls have one or more apertures, and wherein the apertures are adapted to receive the adapter clips.

7. The grounding clamp according to claim 1, further comprising a slot formed by each of the respective members and one of the side walls.

8. The grounding clamp according to claim 7, wherein each of the bottom seating surfaces has a lip.

9. The grounding clamp according to claim 7, wherein each of the side walls has at least one notch which extends upwardly from one of the slots.

10. The grounding clamp according to claim 7 further comprising a fitting plate or a half-fitting plate, wherein the fitting plate or half-fitting plate is accommodated by the slots in the opposing side walls.

11. A grounding clamp for electrically connecting one or more grounding lines to a grounding post, the grounding clamp comprising:

a top section having an aperture;

a pair of opposing side walls extending downwardly from the top section;

one or more members extending downwardly from each of the side walls;

one or more bottom seating surfaces connected to each of the side walls by the members, wherein each seating surface is adapted to accommodate a grounding line;

a wire nut tensioner having a threaded opening;

a clamping bolt extending through the aperture in the top section and engaging the threaded opening in the wire nut tensioner; and at least one clamp formed by the top section and the wire nut tensioner, wherein the clamp is adapted to accommodate a grounding line between the top section and the wire nut tensioner, wherein tightening the clamping bolt electrically and mechanically contacts the bottom seating surfaces and the clamp with the grounding lines.

12. The grounding clamp according to claim 11, wherein the top section, the pair of side walls, the wire nut tensioner and the clamping bolt are formed from electrically conductive material.

13. The grounding clamp according to claim 11, further comprising a fitting plate which extends between at least one of the bottom seating surfaces on each of the side walls.

14. The grounding clamp according to claim 11 further comprising a plurality of teeth extending upwardly from one or more of the bottom seating surfaces.

15. The grounding clamp according to claim 11 further comprising at least one adapter clip, wherein the adapter clip is positioned between the side walls.

16. The grounding clamp according to claim 15, wherein each of the side walls comprises at least one aperture for engaging one of the adapter clips.

17. The grounding clamp according to claim 11 further comprising at least two slots, wherein each of the slots is formed by one of the side wall, one of the members and one of the bottom seating surfaces.

18. The grounding clamp according to claim 17, wherein a lip extends upwardly from each of the bottom seating surfaces into each of the slots.

19. The grounding clamp according to claim 17, wherein a notch extends upwardly into one of the side walls from each of the slots.

20. The grounding clamp according to claim 11, wherein the top section has first and second ends and the wire nut tensioner has opposing ends, and wherein a pair of clamps are formed by the first and second ends of the top section and the opposing ends of the wire nut tensioner.

21. The grounding clamp according to claim 20, wherein the pair of clamps close when the clamping bolt is tightened and engages the wire nut tensioner.

22. The grounding clamp according to claim 17, wherein the bottom seating surfaces extend laterally and outwardly from the members.

23. The grounding clamp according to claim 11, wherein the opening in the wire nut tensioner corresponds to the aperture in the top section, and wherein the wire nut tensioner is positioned between the side walls.

24. A grounding clamp for electrically connecting one or more grounding lines to a grounding post, the grounding clamp comprising:

a top section comprising a first end, a second end, two sides and an aperture;

a pair of side walls extending downwardly from the sides of the top section, wherein each side wall comprises an interior surface and one or more members extending downwardly and connecting to one or more bottom seating;

a wire nut tensioner having two opposing ends and a threaded opening;

a pair of clamps formed by the first and second ends of the top section and the opposing ends of the wire nut tensioner; and a clamping bolt extending through the aperture in the top section and engaging and passing through the threaded opening in the wire nut tensioner, wherein the top section, the side walls, the wire nut tensioner and the clamping bolt are formed from electrically conductive material.

25. The grounding clamp according to claim 24 further comprising a fitting plate which extends between at least one of the bottom seating surfaces on each of the side walls.

26. The grounding clamp according to claim 24 further comprising a plurality of teeth extending upwardly from at least one bottom seating surface.

27. The grounding clamp according to claim 24 further comprising at least one adapter clip, wherein the adapter clip is positioned on the interior surface of at least one of the side walls, and wherein at least one of the side walls comprises at least one aperture for engaging the adapter clip.

28. The grounding clamp according to claim 24, wherein the pair of clamps close when the clamping bolt is tightened.

29. A grounding clamp for electrically connecting one or more grounding lines to a grounding post, the grounding clamp comprising:

a top section comprising a first end, a second end and an aperture;

a pair of opposing side walls extending downwardly from the top section;

at least one member extending downwardly from each of the side walls and each member forming a bottom seating surface;

a wire nut tensioner having two opposing ends and a threaded opening;

a pair of clamps formed by the first and second ends of the top section and the opposing ends of the wire nut tensioner, wherein each of the clamps is adapted to accommodate a grounding line;

a clamping bolt extending through the aperture in the top section and engaging and passing through the threaded opening in the wire nut tensioner; and one or more slots in each side wall, wherein each slot is formed by the side wall, one of the members and one of the bottom seating surfaces, and wherein each of the bottom seating surfaces is adapted to accommodate a grounding line, wherein the top section and side walls are adapted to receive a grounding post, and wherein the grounding lines are installed and the clamping bolt tightened to electrically and mechanically contact the pair of clamps and the bottom seating surfaces with the grounding lines.

* * * * *